US006607110B2

(12) United States Patent
Nusbaum

(10) Patent No.: US 6,607,110 B2
(45) Date of Patent: Aug. 19, 2003

(54) SHEET MATERIAL DISPENSER PACKAGING

(76) Inventor: Harvey J. Nusbaum, 53 Davids Ct., Dayton, NJ (US) 08810

( * ) Notice: Subject to any disclaimer, the term of this patent is extended or adjusted under 35 U.S.C. 154(b) by 23 days.

(21) Appl. No.: 09/978,891

(22) Filed: Oct. 17, 2001

(65) Prior Publication Data

US 2003/0071101 A1 Apr. 17, 2003

(51) Int. Cl.[7] ..... B26D 3/00; B26D 7/00

(52) U.S. Cl. ..... 225/43; 225/18; 225/41; 225/77

(58) Field of Search ..... 225/10, 11, 17, 225/18, 39, 41, 43, 77; 206/459.5, 395, 769, 776, 820

(56) References Cited

U.S. PATENT DOCUMENTS

| | | | | | |
|---|---|---|---|---|---|
| 1,848,859 | A | | 3/1932 | Wishart | |
| 1,917,376 | A | * | 7/1933 | Lee et al. | 225/43 |
| 1,935,970 | A | | 11/1933 | Wooster et al. | |
| 1,985,228 | A | | 12/1934 | Borroughs | |
| 2,215,052 | A | * | 9/1940 | Price et al. | 225/8 |
| 2,319,071 | A | * | 5/1943 | Mason | 225/43 |
| 2,507,403 | A | | 5/1950 | Gluck | |
| 2,824,374 | A | * | 2/1958 | Abrams et al. | 33/763 |
| 2,936,936 | A | * | 5/1960 | Sano | 225/43 |
| 3,093,279 | A | * | 6/1963 | Bryant | 225/43 |
| 3,158,938 | A | | 12/1964 | Phillips et al. | |
| 3,255,531 | A | * | 6/1966 | Anderson | 33/765 |
| 3,375,590 | A | * | 4/1968 | Quenot | 33/765 |
| 3,477,624 | A | * | 11/1969 | Branyon et al. | 225/43 |
| 3,690,528 | A | * | 9/1972 | O'Connor | 225/37 |
| 4,202,613 | A | * | 5/1980 | Haning et al. | 353/120 |
| 4,370,409 | A | * | 1/1983 | Bostroem | 430/496 |
| 4,875,635 | A | * | 10/1989 | Steltzer | 242/412.1 |
| 4,901,663 | A | | 2/1990 | DeLuca | |
| 5,607,121 | A | | 3/1997 | Boriani et al. | |
| 5,816,165 | A | | 10/1998 | Huston | |
| 6,068,209 | A | | 5/2000 | Nakamura | |
| 6,082,662 | A | | 7/2000 | Gallien | |

FOREIGN PATENT DOCUMENTS

| | | | | |
|---|---|---|---|---|
| JP | 2000142683 A | * | 5/2000 | B65D/5/72 |

* cited by examiner

*Primary Examiner*—Allan N. Shoap
*Assistant Examiner*—Isaac N Hamilton
(74) *Attorney, Agent, or Firm*—Kenneth Watov; Watov & Kipnes, P.C.

(57) ABSTRACT

A sheet material product includes a length of substantially planar material with a series of linear scale indicia applied along the length of the substantially planar material, and a dispensing member adapted for retaining and dispensing the length of the material, the dispensing member further including a reference indicator in operative association with the series of linear scale indicia to indicate the amount of the material dispensed and/or the amount of the material remaining in the dispensing member.

7 Claims, 2 Drawing Sheets

SHEET MATERIAL DISPENSER PACKAGING

FIELD OF THE INVENTION

The present invention relates generally to a sheet material product, and more particularly to sheet material dispenser packaging designed to indicate measured amounts of sheet material drawn during dispensing, and the amount remaining therein.

BACKGROUND OF THE INVENTION

Sheet material such as aluminum foil, paper products, plastic films and the like, are usually packaged in association with a dispenser or holder to yield an integrated sheet material product for both consumer and industrial use. The packaging for such material is typically a container used for storing and protecting the packaged item, and is often used as a dispenser. Packaging for sheet material is known in the art and is quite useful for preventing contamination by dirt, insects, bacteria, mold, moisture, or oxygen, for example. Typically the sheet material is packaged in roll form and dispensed through a slotted opening. A cutting blade is usually provided and mounted on the packaging to facilitate separation of the dispensed portion from the roll in the package. Alternatively, the sheet material may be folded into a stacked form and dispensed in a similar fashion. Some of these products include pre-cut or perforated sheet material for dispensing discrete, fixed sheet amounts.

In many applications including those involved in food service and packaging, the use of sheet material products is quite extensive. Users of such products dispense the sheet material by drawing out the material, and cutting or separating the desired portions from the package. Often, it is preferable for the user to measure the dispensed portion prior to cutting to minimize waste. Some products adapted for measuring length amounts include straight-edged rulers placed in alignment with the dispensed material, mechanical counters, mechanical level indicators, and the like. Such products are often unreliable, tedious and time consuming to use, as well as being complicated and costly to assemble and implement. Such methods also add to the bulk of packaging which undesirably adds extra space requirements. In addition, many of these methods are limited and fail to simultaneously indicate the amount of sheet material remaining in the package. Conversely, means for indicating remaining amounts of sheet material in a package often are not adapted for measuring amounts dispensed.

Accordingly, there is a need for sheet material packaging designed to indicate measured amounts of sheet material drawn during dispensing, and the amount remaining therein. There is a further need for such sheet material packaging that is simple, compact, inexpensive and easy to assemble and implement. It would be desirable to implement sheet material packaging for dispensing a range of sheet materials including, but not limited to metal foils, polymer films including plastic and elastomers, paper sheets, fabric sheets, and the like, for application in a range of uses. It would be further desirable to design sheet material packaging that overcomes the limitations of the prior art methods in a cost effective and simple manner.

SUMMARY OF THE INVENTION

The present invention is generally directed to sheet material packaging designed to indicate measured amounts of sheet material drawn during dispensing, and the amount remaining therein. In one aspect of the present invention, the sheet material product includes a length of sheet material with a series of linear scale indicia applied along a surface thereof, and dispensing means for retaining and dispensing desired lengths of the sheet material. The dispensing means further includes a reference indicator operatively associated with the series of the linear scale indicia on the sheet material for indicating to the user both the dispensed amount of the sheet material before severance, and the amount remaining within the dispensing means. The series of indicia of the present invention may be applied directly or indirectly on the sheet material being dispensed and indicates by its relative position, the length of the sheet material dispensed, and the length of the undispensed sheet material remaining within the packaging.

In one particular aspect of the present invention, there is provided a packaging system for sheet material which comprises:

a length of substantially planar material with a series of linear scale indicia applied along the length thereof; and dispensing means adapted for retaining and dispensing a desired length of the material, the dispensing means further including a reference indicator in operative association with the series of linear scale indicia to indicate a desired amount of the material to be dispensed, and/or the amount of the material remaining in association with the dispensing means.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is generally related to sheet material packaging for dispensing sheet material with linear scale indicia applied along the length thereof. Generally, the present invention comprises a length of sheet material and a dispensing means for retaining and dispensing the sheet material. The sheet material can comprise any substantially planar material of a range of widths and thickness suitable for storage and dispensing, and can be provided in a form compatible for convenient dispensing including rolled and stacked forms. In one particular aspect, the present invention provides the user with visual means to accurately measure the length of the sheet material as it is being drawn, and simultaneously monitor the depletion of the sheet material remaining in the associated container. In addition, the sheet material packaging of the present invention is easy and cost effective to produce using commercially known methods. In accordance with the present invention, the convenient and compact manner in which the sheet material product can be fabricated and implemented makes it especially suitable for a range of applications including, but not limited to, food service, package-making, consumer, and retail use, for example.

Figure 1:
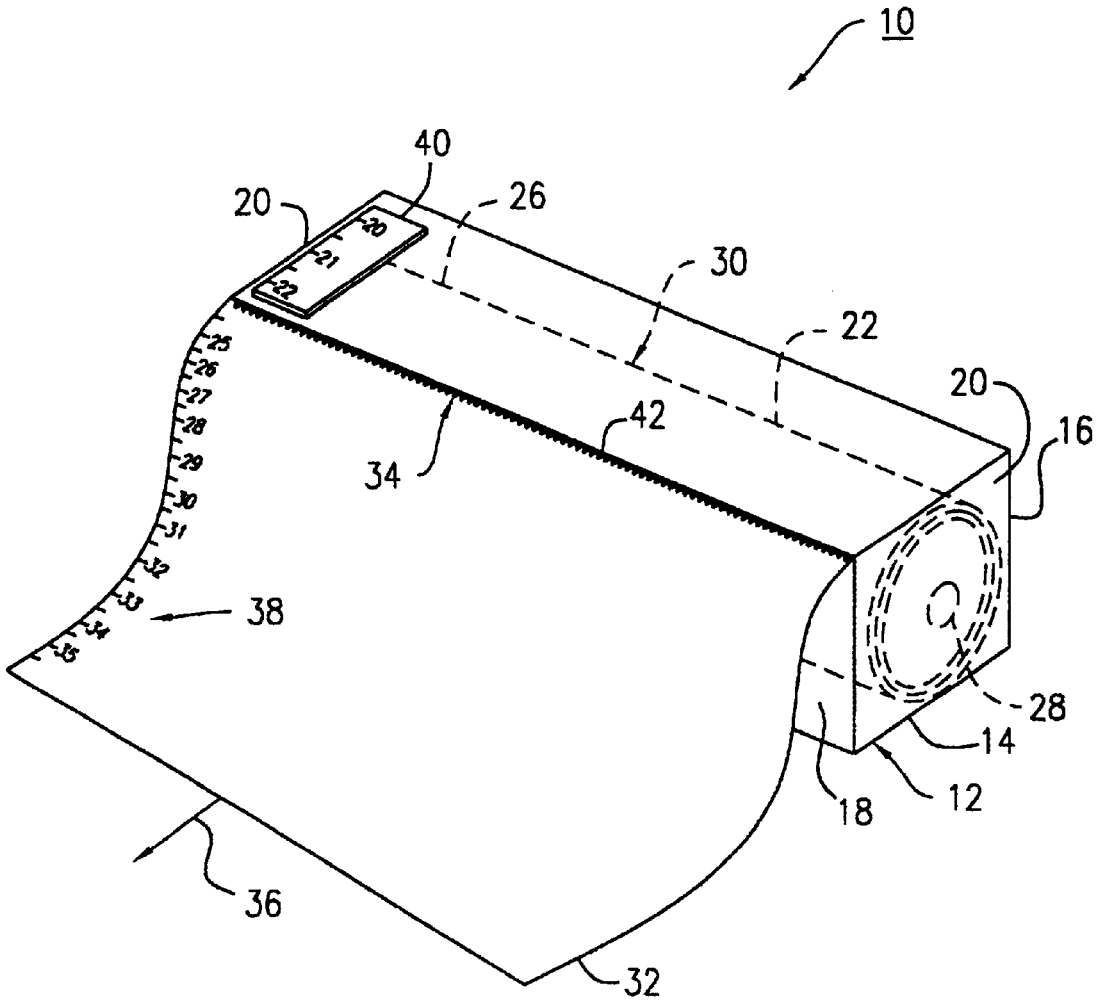
FIG. 1 is a perspective view of sheet material packaging for one embodiment of the present invention.

With reference to FIG. 1, a sheet material packaging configuration is generally designated by the reference numeral 10, for one embodiment of the present invention. The sheet material packaging 10 generally comprises a container 12 with a rectangular configuration. The container 12 includes an interior volume 24 (as shown best in FIG. 2) enclosed by an elongated rectangular base 14, a rectangular rear panel 16, an elongated rectangular front panel 18, a pair of square side panels 20 coupled therebetween, and a top rectangular lid 22 for permitting access to the interior volume 24 thereof, in this example.

The container 12 may be comprised of any suitable rigid and durable material. The container 12 is a substantially complete self contained sealed box or unit preferably formed from a corrugated cardboard material, and sealed up to the usual flaps and openings therein through which material contained therein may be dispensed. The product 10 further includes a quantity of sheet material 26 wound or journalled around a spool 28 to form a roll 30. An end portion 32 of the sheet material 26 extends through a slit-like opening 34 for permitting dispensing sheet material 26 in the direction of the arrow 36 as desired and needed. The roll 30 is arranged in any suitable manner so that as the material 26 is pulled out of the container 12 the roll 30 will turn therein but sufficient friction is provided to create desired resistance to movement so that overrunning will not occur.

The sheet material 26 is sealed within the container 12 until premeasured dispensing commences as will be described. The sheet material 26 is free from dirt, moisture, dust, air and the like, while protected within the container 12. The slit opening 34 is dimensioned to be in contact with the sheet material 26 to slightly grip it to prevent self unrolling. In this manner, the sheet material 26 is positively pulled out of the container 12 against the frictional gripping thereon. In addition, the sheet material 26 forms a barrier in the slit opening 34 to prevent entry of external contaminants thereinto.

The sheet material 26 may include any sheet item including, but not limited to tapes, strips, paper sheets, ribbons, elastomer films, polymer films, plastic wraps, metal foils such as aluminum, wax papers, parchment papers, butcher papers, gift wrap papers, fabric sheets, wall papers, carpetings, rugs, packing sheets, cellophane films, packaging films, and the like. The shape of the container 12 is not limited to the shape shown in FIG. 1, and may include other shapes, sizes and configurations deemed necessary or desirable, and may depend on several factors including product use, application, sheet material, and the like.

Referring again to FIG. 1, the sheet material 26 includes a series of indicia 38 applied along the length of an edge thereof. The series of indicia 38 may be applied through a range of means including, but not limited to, sewing, printing, woven, gluing, lithographing, embossing, and the like or otherwise attached or mounted directly or indirectly upon the sheet material 26. The series of indicia 38 is arranged on a linear scale to provide quantitative information about the sheet material 26 in the product 10. The series of indicia 38 enables a user to accurately mete out the desired length of the sheet material 26 visually as it is being drawn from the container 12. At the same time, the series of indicia 38 also provides the user with quantitative information about the length of sheet material 26 remaining in order to anticipate the depletion thereof.

Any measurement typically involves the comparison of a measured quantity with a known standard unit. The series of indicia 38 may have graduations or rulings, for example, for measuring material drawn from the container 12. The series of indicia 38 may comprise a plurality of evenly spaced ticks or marks applied in association with numerical indications. The distance between each tick may correspond to a standard length unit such as inches or centimeters, for example. The numerical indications may represent the length of sheet material dispensed and remaining in the product 10. The series of indicia 38 may be applied along any surface portion of the sheet material (e.g. along the edge, or along the middle portion), and in the alternative, the series of indicia 38 can be imprinted indirectly on a strip of tape, for example, and reversibly affixed to the sheet material which may be removed upon dispensing.

In the example of FIG. 1, assume the indicia ticks are one-half inch apart, and the numerals shown represent the length of sheet material 26 from a given numeral that remains back to the trailing end of the associated roll 30. In FIG. 1, for example the amount of sheet material 26 drawn out of the container 12 from the slit opening 34 is (36-inches−26 inches=10 inches). Accordingly, through use of simple subtraction, a user will be able to accurately measure a desired length of sheet material 26.

The incorporation of the series of indicia 38 into the sheet material packaging 10 enables the user to monitor the supply of the sheet material 26 without requiring the user to open the container 12, and allows the user to predict the point in time by which the sheet material 26 will require replenishing. In this manner, time is saved for the user as the series of indicia 38 will indicate the amount remaining within the container 12, or its complete depletion. In addition, the series of indicia 38 eliminates the need to use prior known costly and complicated mechanisms for the same purpose. It is understood that the content and design of the series of indicia 38 may include any and all forms that is useful for indicating to the user the amount of sheet material dispensed as well as the amount of sheet material remaining in the container 12 as known to one of ordinary skill in the art. The example given in FIG. 1 is not meant to be limiting.

To provide a reference point for measuring the dispensed portion of the sheet material 26, the container 12 includes a window 40 mounted into the top rectangular lid 22 aligned with the series of indicia 38 on the sheet material 26. The window 40 permits the user to visually see the indicia 38 on a lead portion of the sheet material 26 residing in the interior volume 24 of container 12. The window 40 can be mounted on any portion of the container 12 depending on the location of the series of indicia 38 on the sheet material 26. The container 12 further includes a cutting edge 42 extending along the slit opening 34 to facilitate the separation of the dispensed end 32 of the sheet material 26 from the packaging 10. The cutting edge 42 contacts and catches the sheet material 26 as the end portion 32 deflects upward. An upward pulling force applied to the end portion 32 causes the cutting edge 42 to transversely cut and separate the end portion 32 of the sheet material 26 from the roll 30 as it is ripped off.

Figure 2:
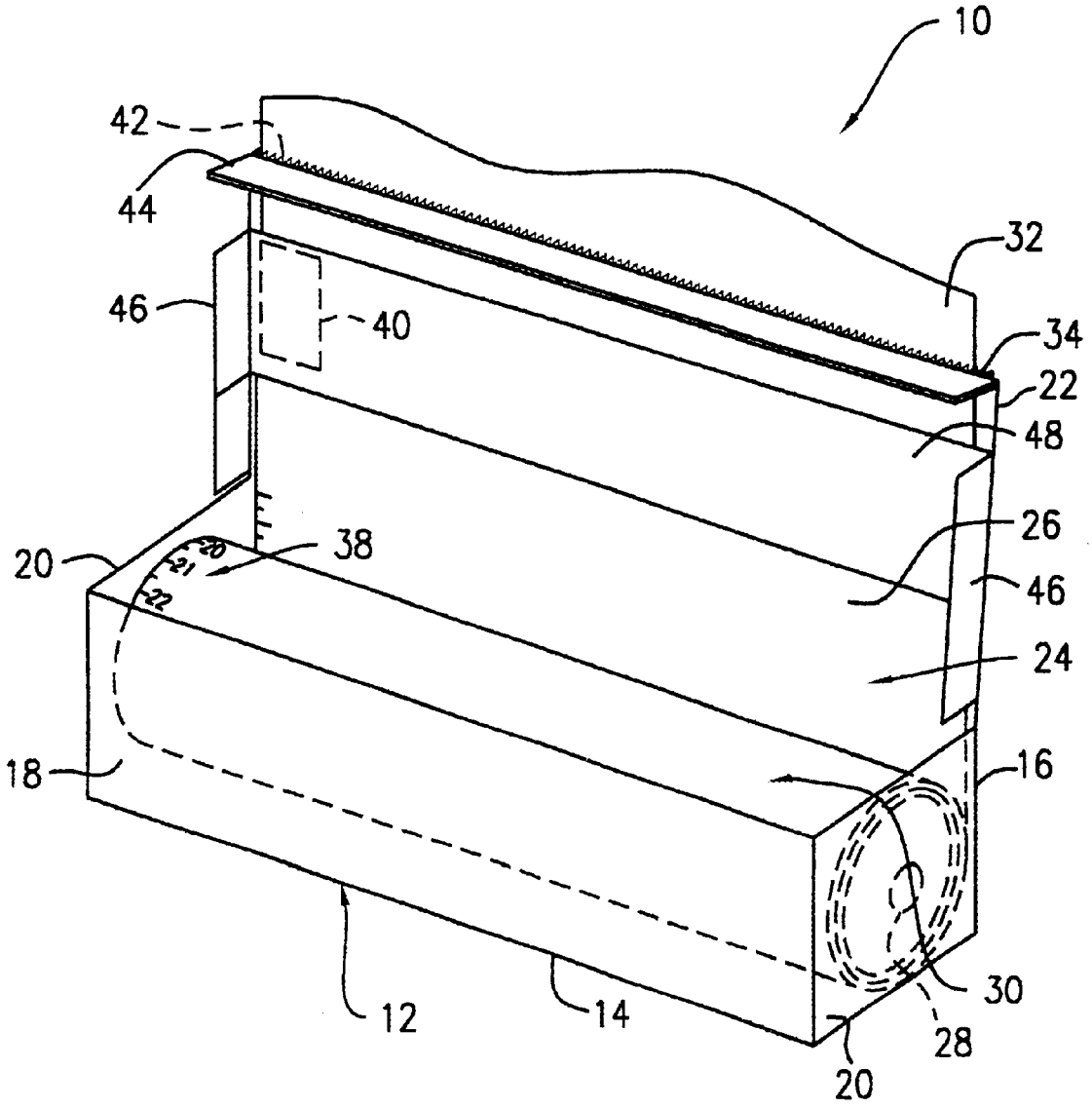
FIG. 2 is a perspective view of the sheet material packaging of FIG. 1 with a lid in an open position in accordance with the present invention.

Referring to FIG. 2, the sheet material product 10 is shown with the top rectangular lid 22 in an open position to illustrate the interior thereof. The lid 22 includes a front lip 44 for defining the slit opening 34, and a air of side flaps 46 each at one end thereof. The front lip 44 and the side flaps 46 are each frictionally engaged with an inside surface of the front panel 18 and the side panels 20, respectively, in the closed position. With this feature, the lid 22 is securely retained in the closed position particularly during use of the product 10.

The bottom face of the lid 22 further includes a retaining strip 48 extending from one end to the other end thereof proximate the side flaps 46. The dispensed end 32 of the sheet material 26 extends between the bottom of the lid 22 and the retaining strip 48. The retaining strip 48 biases the sheet material 26 flush against the bottom face of the lid 22. In this regard, the indicia 38 is retained against the window 40 for optimizing measuring accuracy and maximum viewing clarity and visibility. The retaining strip 48 also prevents the roll 30 of the sheet material 26 from unrolling under its own accord and provides some frictional gripping for a controlled pull for effective measuring and dispensing.

With reference to FIGS. 1 and 2, the operation and use of the sheet material product 10 will be described. The user grips the end portion 32 of the sheet material 26 journalled around the spool 28 in the interior volume 24 through the slit opening 34. The retaining strip 48 holds the immediate portion of the sheet material 26 with the series of indicia 38 biased against the window 40 for clarity and optimal visibility. The user pulls the end portion 32 in the direction of the arrow 36 while monitoring the series of indicia 38 displayed in the window 40. Simultaneously, the user may also note the amount of the sheet material 26 remaining in the container 12 from the series of indicia 38 displayed in the window 40. When the desired length of sheet material 26 has been withdrawn, as indicated by substracting or counting successive indicia 38, the user deflects the end portion 32 upward to contact the cutting edge 42. The cutting edge 42 cuts transversely along the sheet material 26 for executing a clean detachment therefrom, as previously described. The user may proceed to use the dispensed portion of the sheet material 26 as desired. The remaining portion of the sheet material 26 is effectively protected and stored in the container 12 as the window 40 continues to display the series of indicia 38, whereby the amount remaining in the sheet material packaging 10 is effectively indicated by the indicia 38 appearing in window 40.

With respect to the above description then, it is to be realized that the optimal dimensional relationships for the components of the invention, to include variations in size, materials, shape, form, function, and manner of operation, assembly and implementation, are deemed readily apparent and obvious to one skilled in the art, and all equivalent relationships to those illustrated in the drawings and described in the specification are intended to be encompassed in the present invention.

Accordingly, although various embodiments of the invention have been shown and described, they are not meant to be limiting. Those of skill in the art may recognize various modifications to these embodiments, which modifications are meant to be covered by the spirit and scope of the appended claims.

What is claimed is:

1. A sheet material packaging configuration comprising:

a container including an interior volume enclosed by at least one wall, and an opening in communication with the interior volume;

a window mounted in one of the at least one wall of said container;

a length of sheet material residing within the interior volume, said sheet material being dispensable through the container opening;

a series of length graduated indicia including alphanumeric characters of decreasing order applied along the length of said sheet material, said series of length graduated indicia being viewable through the window to indicate the amount of the material dispensed and/or the amount of the material remaining in the dispenser, and cutting means mounted on said container for cutting a dispensed portion from the length of the sheet material residing within the interior volume.

2. The sheet material packaging configuration of claim 1, wherein the series of length graduated indicia further includes a plurality of equally spaced apart ticks.

3. The sheet material packaging configuration of claim 1, wherein the sheet material is selected from the group consisting of paper sheets, metal foils, elastomer films, fabric sheets, and polymer films.

4. The sheet material packaging configuration of claim 1, wherein the length of the sheet material is in a form selected from the group consisting of rolls and stacks.

5. The sheet material packaging configuration of claim 1, wherein the cutting means further includes a cutting blade mounted along the edge of the container opening.

6. The sheet material packaging configuration of claim 1, wherein the series of length graduated indicia is imprinted directly sheet material.

7. The sheet material packaging configuration of claim 1, wherein the wall accommodating the window includes retaining means located on the inside surface thereof for biasing the planar material against the inside surface of the window.

* * * * *